United States Patent [19]

Robinson

[11] 4,372,321

[45] Feb. 8, 1983

[54] MOLDED REINFORCED BREAST CUP AND METHOD FOR MAKING SAME

[75] Inventor: Earl Robinson, Marietta, Ga.

[73] Assignee: The Lovable Company, Norcross, Ga.

[21] Appl. No.: 141,329

[22] Filed: Apr. 18, 1980

[51] Int. Cl.[3] ..... A41C 3/00

[52] U.S. Cl. ..... 128/463

[58] Field of Search ..... 128/477, 463, 516, 517, 128/464, 465, 484

[56] References Cited

U.S. PATENT DOCUMENTS 3,021,844 2/1962 Flagg et al. ..... 128/463

3,146,779 9/1964 Flagg ..... 128/463

*Primary Examiner*—Doris L. Troutman

*Attorney, Agent, or Firm*—Henry R. Lerner

[57] ABSTRACT

A molded breast cup for use in brassieres and other garments. The breast cup comprises an outer layer, an inner layer and an intermediate reinforcing layer sandwiched between the outer and inner layer. A fusable material is provided on the surface of the intermediate layer confronting the outer layer and on the surface of the inner layer confronting the other two layers. The three layers are aligned in juxtaposed relation and molded between heated male and female molding members to form a unitary molded breast cup in which the intermediate layer provides reinforcement for the cup.

8 Claims, 11 Drawing Figures

MOLDED REINFORCED BREAST CUP AND METHOD FOR MAKING SAME

BACKGROUND OF THE INVENTION

The present invention relates to brassieres and particularly to brassieres in which the breast cups thereof are provided with means for supplementing the support of the wearer's breasts. In the prior art, such additional support was conventionally obtained by providing wires, stays, or the like along the bottom part of each of the breast cups. Such arrangements, however, soon proved to be unsatisfactory because of the substantial discomfort imparted to the wearer by the pressure of such auxiliary supporting means upon the body of the wearer.

In order to overcome the above pointed out disadvantages, the prior art adopted the use of supplementary fabric layers secured in one form or another to the cup proper for such reinforcement purposes. Typical examples of such prior art are illustrated in U.S. Pat. Nos. 2,128,600, 2,604,625, and 2,899,961.

With the advent of molded brassieres wherein the conical shape of the breast cup was obtained during a molding operation, further means were devised for incorporating support material for the cup within the breast cups. A recent example illustrating the incorporation of auxiliary support means in a molded cup is illustrated in U.S. Pat. No. 4,172,002. In accordance with the disclosure of this patent, a segregated fabric portion is laminated to a selected thermoplastic support material and a flat support patch is then die cut out of the lamination. Such patch, intended to ultimately be located at the bottom part of the breast cup, is then adhered, in flat condition, to a fabric ply, also in flat condition, to create a unitary cup segment which is then molded into the required cup shape.

In accordance with this procedure, two laminating steps are in fact required before the molding operation can take place and the result obtained by such procedure leaves the support patch in surface to surface engagement with the wearer's breast when the brassiere is worn.

While this latter described procedure may constitute an improvement over the premolding methods referred to above, it is still not entirely satisfactory.

It is therefore an object of the present invention to provide a brassiere having molded cups provided with molded in supplementary support means in an improved and simplified manner not previously disclosed in the prior art.

SUMMARY OF THE INVENTION

In accordance with the present invention, there is provided a brassiere having molded cups, each of which cups comprises an outer and inner layer between which there is sandwiched, at the bottom central part thereof, a reinforcement support layer. The assembling of this three layer cup is essentially obtained during a single molding operation with the utilization of conventional molding apparatus. Unlike the prior art, no separate steps are required, prior to the molding step itself, to adhere the support patch to either the outer cup layer or the inner cup layer. All that is required is the proper selection of materials for the outer and inner layers and for the intermediate reiforcement layer, treated with the proper fusables, to enable the one step molding operation to provide a finished molded cup having a soft feel and having the reinforcement feature located precisely where intended.

The selection of the materials used for the various layers is an important feature of the invention. These materials must be compatible in that they must be capable of being molded and adhering to each other during the molding cycle without shrinking subsequent to the molding operation in order to eliminate the creation of undesirable wrinkles in the molded cup. It has been found that the most suitable material for the outer cup layer, inner cup layer, and intermediate reinforcement layer is 100% polyester tricot fabric. More specifically, for the outer cup layer, a 70 denier firm 100% polyester tricot is very suitable, particularly since subsequent to molding, it is provided with a soft feel on its outer surface. For the inner cup layer, a 40 denier 100% polyester tricot has been found to be quite satisfactory. The inner cup is especially selected to be thinner than the outer cup material since the inner cup layer is in surface to surface confrontation with the body of the wearer. The 40 denier 100% polyester tricot for the inner cup material has also been found not to allow the bleeding therethrough of the fusable substance which is utilized for providing the adherence between the respective layers forming the cup.

The reinforcement intermediate layer is preferably a firm material since it especially defines the added supporting feature for the breast and a most suitable material for the reinforcement layer has been found to comprise a 5½ yard weight 40 denier 100% polyester tricot.

It will be noted that all three layers are 100% polyester tricot fabric varying only in their weight. This renders the three layers compatible with each other from a molding standpoint so that they can be molded during a single molding cycle under the same temperature conditions, whereby to provide uniform stretching and reducing any likelihood of subsequent wrinkling.

While the above described 100% polyester tricot fabrics have been described as being particularly suitable for use with the present invention, it should be understood that other fabrics capable of being molded could equally well be utilized.

In order to enable the molding of the three layers defining the breast cup, namely, the outer cup layer, inner cup layer, and the sandwiched in support layer, it is necessary to provide means to enable the three layers to adhere to each other during the molding process.

In accordance with the preferred embodiment of the invention, the outer cup layer is left free of any fusables, the face of the intermediate supporting layer confronting the outer cup layer is provided with fusable material, and the inner layer is provided with fusable material on the surface thereof confronting the reinforcing layer and the interior surface of the outer cup layer. In this way, when the three layers are molded, the fusable material on the intermediate layer will bond the latter to the outer cup layer and the fusable material on the inner cup layer will be fused partially to the intermediate reinforcing layer and partially to the inner surface of the outer cup layer to form an integral molded cup with the reinforcing layer firmly sandwiched between the inner and outer cups. The fusable material contemplated herein is a polyester hot melt adhesive.

A preferred way of applying fusable material in accordance with the invention is by the use of screens which allow dotted coverage of a surface. For the intermediate reinforcing layer, a coverage of 11 dots per inch 4 milimeters width has been found satisfactory to insure proper adhesion during the molding process and to impart to the intermediate layer an uplift firmness after the molding. While more dots per inch could be used, probably increasing the firmness of the intermediate support layer, 11 dots per inch is deemed preferable as it still provides the desired feel for better fit and comfort.

For the inner cup a coverage of 11 dots per inch 4 millimeters width has also been found most suitable, particularly to reduce the firmness in that portion of the inner cup which will adhere to the outer cup layer, above the intermediate support layer.

Under the above described arrangement, the outer cup layer is not treated with a fusable whatsoever. It will be understood, however, that other arrangements for placing fusables on the respective layers could be provided whereby, during the single molding step, the three layers are secured to each other with the intermediate support layer sandwiched between the inner and outer layers. It is thus seen that the formation of a molded cup in accordance with the invention requires an outer cup layer, an intermediate reinforcing layer, and an inner cup layer, all of which are pre-die cut to an appropriate size, sufficiently large to permit effective molding to take place and yet prevent shrinkage in the mold, while at the same time leaving enough material on the outside of the cup to ultimately die cut the molded cups into the desired sizes as required.

It is also important that, prior to the molding operation, the pre-cut panels comprising the inner, outer and reinforcement layer are properly aligned so that the location of the reinforcing layer will be where intended, namely, at the bottom central part of the cup and will always be at the same pre-selected position. This is accomplished by providing each of the three panels comprising the cup with a center notch so that the three panels can be aligned with respect to each other and with respect to the molding apparatus to always produce uniformly molded cups with the reinforcement panel always occupying the same desired position. For such purpose, appropriate markings are provided on one of the molds to enable the positioning of the cup panels and their notches where required to guarantee that each molded cup will be identical to each other molded cup.

DESCRIPTION OF THE PREFERRED EMBODIMENT

Figure 1:
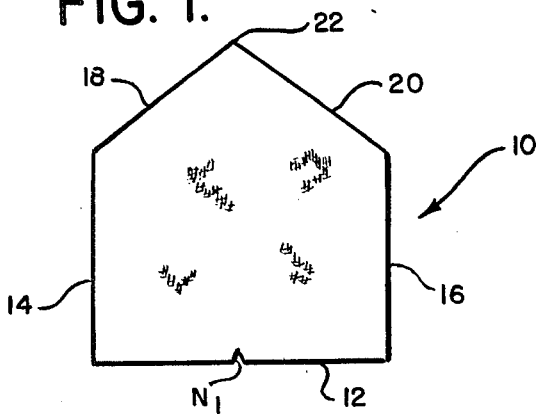
FIG. 1 is a plan view of a panel defining the outer cup layer.

Referring now to FIG. 1 there is shown a panel 10 which defines the outer cup layer, and is preferably a 70 denier firm 100% polyester. The shape and size of panel 10 is dictated by the particular bra for which the cup is being made but includes a rectilinear bottom edge 12, vertical side edges 14 and 16 and upper edges 18 and 20 which converge at 22. As shown, bottom edge 12 is notched at $N_1$, preferably midway side edges 14 and 16 and in vertical alignment with 22. In the preferred embodiment, outer cup layers defining panel 10 is not treated with any fusable.

Figure 2:
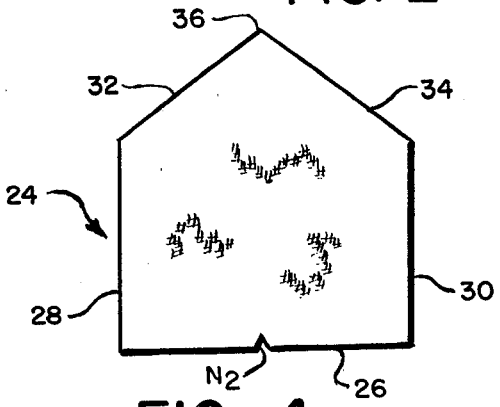
FIG. 2 is a plan view of a panel defining the inner cup layer.

FIG. 2 illustrates panel 24 which defines the inner cup layer and is preferably a 40 denier 100% polyester tricot one surface of which has been treated with a fusable coverage of 11 dots per inch 4 mm width. Panel 24 is shaped similarly to panel 10, having rectilinear bottom edge 26, vertical side edges 28 and 30, and upper edges 32 and 34 which converge at 36. A notch $N_2$ is provided midway on bottom edge 26 in vertical alignment with 36.

Figure 3:
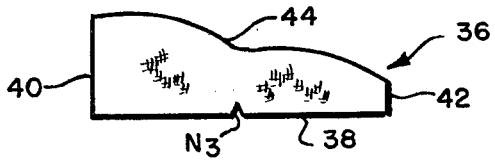
FIG. 3 is a plan view of a panel defining the intermediate reinforcing layer.

FIG. 3 illustrates panel 36, which defines the intermediate reinforcing layer and is preferably a $5\frac{1}{2}$ yard weight 40 denier polyester tricot, includes a rectilinear bottom edge 38, vertical unequal length side edges 40 and 42 which are joined at their upper ends by curvilinear top edge 44. As shown, bottom edge 38 is notched at $N_3$, midway of side edges 40 and 42. The upper surface of panel 36 is treated with a fusable coverage of 17 dots per inch 3 mm width.

Figure 4:
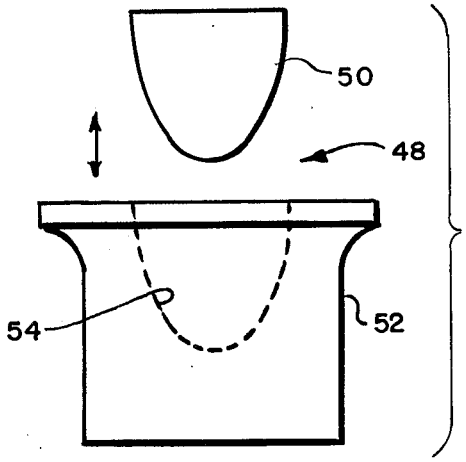
FIG. 4 is a front elevational view, schematically shown, of the mold members.

FIG. 4 illustrates, schematically, conventional molding apparatus 48 adapted for use in molding the cup in accordance with the invention and comprises top mold member 50 and bottom mold member 52, said mold members being provided with conventional means for the heating thereof to preselected temperatures and for inserting male mold member 50 within the cavity 54 of female mold member 52.

Figure 5:
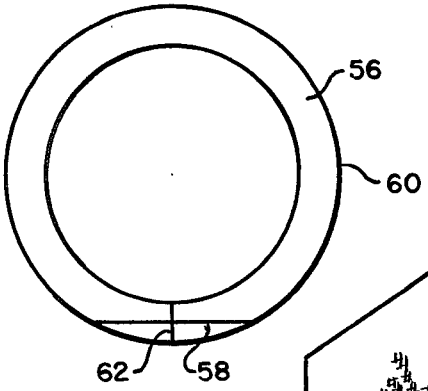
FIG. 5 is a top plan view of the bottom mold, as viewed from line 5—5 of FIG. 4.

As shown in FIG. 5, cavity 54 of bottom mold member 52 is provided with a peripheral planar flange 56 which defines the supporting surface for the superposed panels prior to the molding operation. Flange 56 is provided with scribed marking 58 which extends as a cord of outer contour 60, such marking being perpendicularly bisected by radial scribed marking 62 so that each scribed marking bisects the other.

Figure 6:
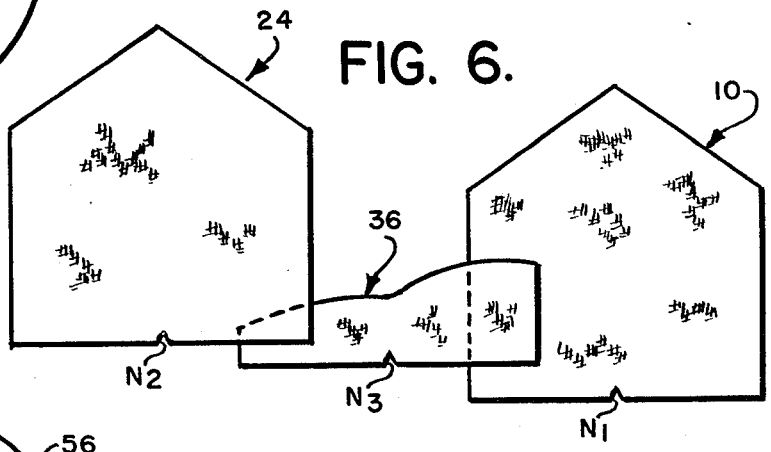
FIG. 6 is an exploded view of the three panels showing the manner in which they are superposed prior to the molding operation.

Prior to the molding operation the three panels are juxtaposedly aligned as best illustrated in the exploded view of FIG. 6 wherein panel 10 is lowermost, panel 24 is uppermost and panel 36 is sandwiched therebetween. When so aligned all the respective bottom edges 12, 26 and 38 are superposed relation as are their respective notches $N_1$, $N_2$ and $N_3$. In such alignment, it will be noted that the surface of panel 36 which has been fusably treated is in surface to surface contact with panel (outer cup layer) 10, and the surface of panel (inner cup layer) 24 which has been fusably treated is in surface to surface contact with intermediate panel 36 and panel 10.

Figure 7:
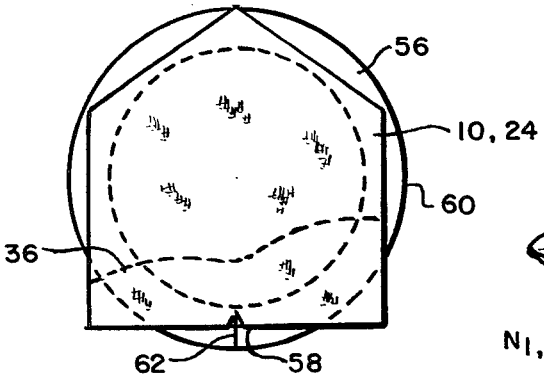
FIG. 7 is a top plan view of the three superposed panels properly aligned on the mold, ready for the molding operation.

The aligned panels are now placed on flange 56 of bottom mold 52, as best shown in FIG. 7, with the superposed bottom edges of the three panels being aligned with scribed marking 58 and the superposed notches being aligned with scribed marking 62. The superposed panels are held in position by conventional means and the upper mold is conventionally lowered, inserted into lower mold cavity 54 to form an integrally molded cup comprising the smooth outer cup layer, smooth inner cup layer and the intermediate reinforcing support layer properly located, as desired, at the central bottom portion of the finished cup. It will be understood that upper edge 44 of intermediate reinforcing layer is shaped as dictated by the particular style design of the brassiere and that the left and right cup panels are in mirror symmetrical relation.

It has been found that in order to achieve proper bonding of the three layer cup as described above the preferred temperature for the top mold is 355° F. and for the bottom mold is 345° F. with a 23 second molding cycle. It is understood, however, that the above temperatures and cycle time may vary depending on the type of fusable used and the type of material used for the respective layers. Following removal of the molded cup assembly it is suitably die cut for incorporation in the completed brassiere, such assembly being shown in FIG. 8.

Figure 8:
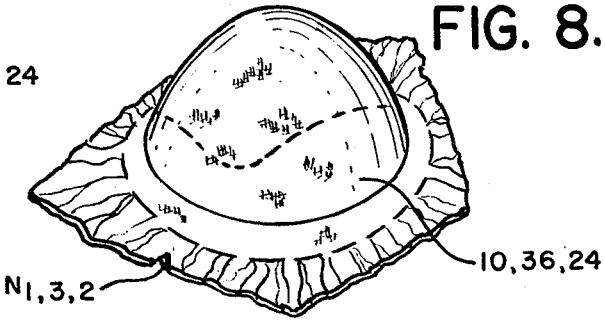
FIG. 8 is a perspective view of a finished molded cup assembly.
Figure 9:
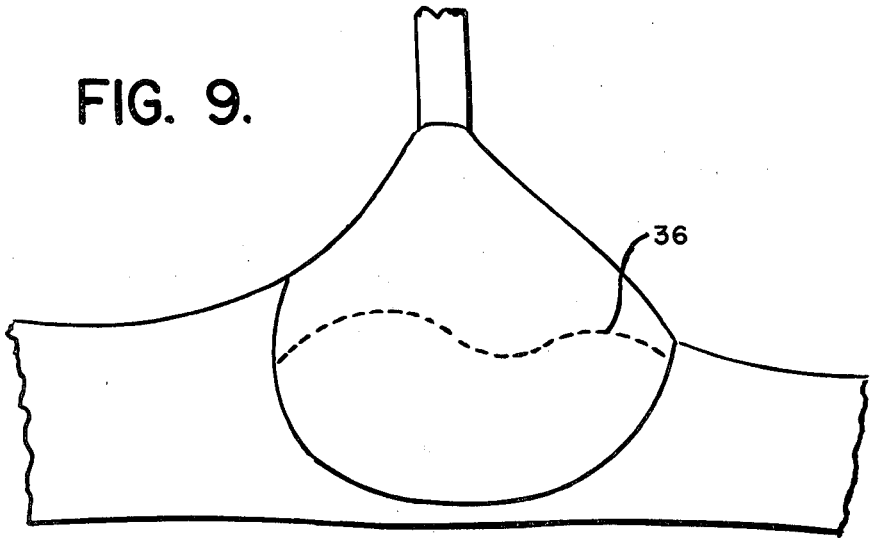
FIG. 9 is a front elevational view of a brassiere front section incorporating the cup assembly of FIG. 8.

FIG. 9 shows a brassiere front section incorporating the cup assembly of FIG. 8. It is apparent from FIG. 9 that the reinforcing sandwiched panel 36 occupies the bottom central portion of the cup assembly to provide the requisite reinforcing support in the cup.

Figure 10:
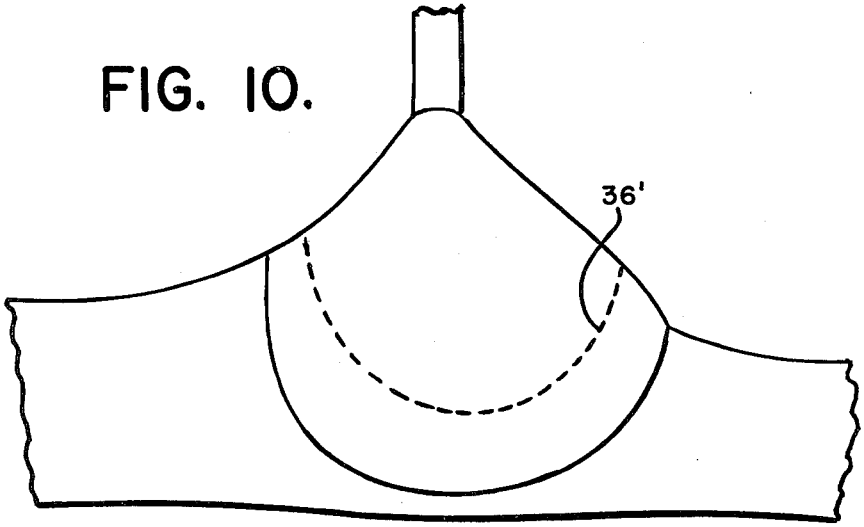
FIG. 10 is a front elevational view of a brassiere front section incorporating a cup assembly in accordance with another embodiment of the invention.
Figure 11:
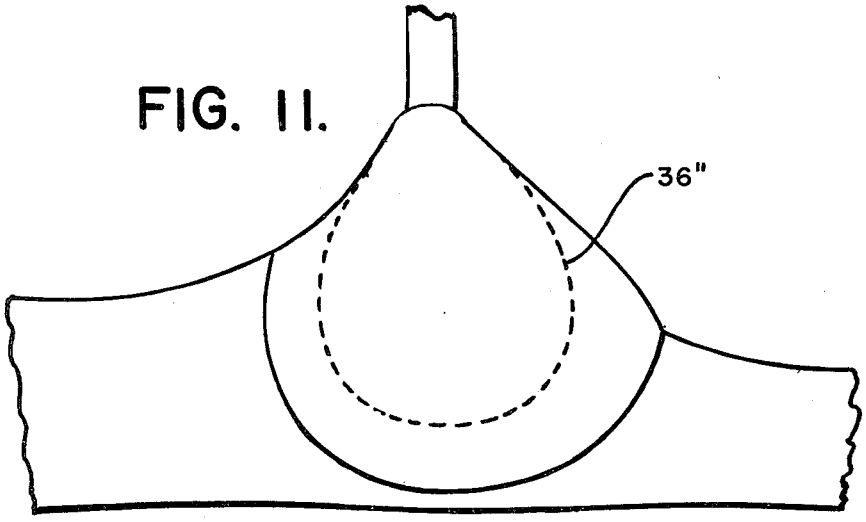
FIG. 11 is a front elevational view of a brassiere front incorporating still another embodiment in accordance with the invention.

FIGS. 10 and 11 illustrate other embodiments of the invention which are in all respects identical to the embodiments of FIGS. 1 through 9 except only that the intermediate reinforcing panels 36' and 36'' respectively, extend along the sides of the cup assembly, in varying degrees, as well as along the central bottom portion thereof.

While the above preferred embodiment has been illustrated with the fusable applied by dotting with the use of screens, other means for applying the fusable may be utilized within the scope of the invention.

It is thus seen that there has been disclosed a novel method for providing a molded cup for a brassiere comprising an outer and inner layer between which there is sandwiched at the bottom central part thereof, a reinforcement support layer, which molded cup is essentially obtained during a single molding operation with the utilization of conventional molding apparatus. It is further seen that, in accordance with the improved method, proper alignment of the respective cup forming layers is easily obtained so that continuously uniform results are obtained without difficulty.

Having thus described my invention, what I claim and desire to secure by letters patent is:

1. A molded breast cup for use in brassieres and other garments, said breast cup comprising (a) an outer layer of fabric having a bottom edge, (b) an inner layer of fabric having a bottom edge, (c) an intermediate reinforcing layer of fabric having a bottom edge, (d) said intermediate layer being sandwiched between said outer and inner layers with the three bottom edges in juxtaposed relation, the height of said intermediate layer being smaller than that of said outer and inner layers, (e) fusable means being provided on some of said layers, (f) said three layers being molded between heated male and female molding members to form a unitary molded breast cup wherein the intermediate layer provides reinforcement at the central bottom part of the cup.

2. A molded breast cup in accordance with claim 1, wherein the three layers are made of 100% polyester tricot fabric.

3. A molded breast cup in accordance with claim 2, wherein the outer layer is made of 70 denier firm 100% polyester tricot, the inner layer is made of 40 denier 100% polyester tricot and the intermediate layer is made of a 5½ yard weight 40 denier 100% polyester tricot.

4. A molded breast cup in accordance with claim 1, wherein the fusable material is applied to the surface of the intermediate layer confronting the outer cup layer, and to the surface of the inner layer confronting the other two layers.

5. A molded breast cup in accordance with claim 4, wherein the fusable material is applied by screens which provide dotted coverage, with the intermediate layer and the inner layer each being provided with a coverage of 11 dots per inch 4 mm width.

6. A molded breast cup in accordance with claim 3, wherein the fusable material is applied to the surface of the intermediate layer confronting the outer cup layer, and to the surface of the inner layer confronting the other two layers, and wherein the fusable material is applied by screens which provide dotted coverage, with the intermediate layer and the inner layer each being provided with a coverage of 11 dots per inch 4 mm width.

7. A molded breast cup in accordance with claim 1, wherein the bottom edge of each of said three layers is notched midway thereof and wherein said notches are in alignment when said bottom edges are in juxtaposed relation.

8. A molded breast cup for use in brassieres and other garments, said breast cup comprising (a) an outer layer of fabric having a bottom edge, (b) an inner layer of fabric having a bottom edge, (c) an intermediate reinforcing layer of fabric having a bottom edge, (d) said intermediate layer being sandwiched between said outer and inner layers with the three bottom edges in juxtaposed relation, the surface area of said intermediate layer being smaller than that of said outer and inner layers, (e) fusable means being provided on some of said layers, (f) said three layers being molded between heated male and female molding members to form a unitary molded breast cup wherein the intermediate layer provides reinforcement for said cup.

* * * * *